United States Patent [19]

Knize

[11] 3,935,963

[45] Feb. 3, 1976

[54] CAP LOCKING MEMBER

[75] Inventor: Elmer J. Knize, Chicago, Ill.

[73] Assignee: Lippy Can Co., Ltd., Chicago, Ill.

[22] Filed: Feb. 24, 1975

[21] Appl. No.: 552,314

[52] U.S. Cl. ..... 220/315; 215/221; 222/153

[51] Int. Cl.[2] ..... B65D 45/00; 222 153

[58] Field of Search ..... 215/216, 221, 9; 220/315

[56] References Cited

UNITED STATES PATENTS

| | | | |
|---|---|---|---|
| 3,200,979 | 8/1965 | Powers | 215/221 |
| 3,567,057 | 3/1971 | Landen | 215/221 |
| 3,881,625 | 5/1975 | Landen | 215/221 |

*Primary Examiner*—George T. Hall

*Attorney, Agent, or Firm*—Max R. Kraus

[57] ABSTRACT

A cap locking member for locking a cap in a closed position relative to the neck or spout of the can or container to prevent removal or unscrewing of the cap by a child and providing a safety factor whereby only an adult can unscrew the cap by using both hands. The said cap locking member is secured to the top of the can or container and has an upwardly extending portion which has a notch or recess with the transversely extending front edge thereof engaging the underside of the cap whereby the front edge is imbedded into the underside of the cap in such a manner as to prevent counterrotation or unscrewing of the cap unless the container is held with one hand and with one of the fingers of that hand applying sufficient manual pressure to depress the manually engageable portion of the locking means to effect disengagement with the cap while simultaneously rotating the cap in a counterclockwise direction with the other hand to unscrew same. The cap locking member is formed essentially of a spring metal which is integrally formed and inexpensive to produce.

9 Claims, 14 Drawing Figures

CAP LOCKING MEMBER

BRIEF SUMMARY OF THE INVENTION

It is well recognized that certain products are dangerous and harmful to children and that unless such products are contained in containers or cans with caps which are difficult if not impossible for children to remove that there is an ever-present danger that a child can unscrew the cap and gain access to the dangerous contents. It is one of the objects of this invention to provide locking means for readily locking the cap against unscrewing from the neck of the container unless the container is held with one hand and with one of the fingers of that hand applying sufficient manual pressure to depress the manually engageable portion of the locking means to effect disengagement with the cap while simultaneously rotating the cap in a counterclockwise direction with the other hand, thus requiring the use of two hands simultaneously and with sufficient strength applied thereto. With this invention it would be extremely difficult if not impossible for a child to operate the cap locking member.

Another object of this invention is to provide a cap locking member which is formed of a spring steel material and which can be readily associated with or connected to a conventional metal can or plastic container utilizing the conventional closure cap.

Another object of this invention is to provide a cap locking member which is formed of a single stamping and integrally formed, thus making it economical to produce, and which may be readily attached to a conventional metal or plastic can or container.

BRIEF DESCRIPTION OF THE DRAWINGS

In the drawings:

FIGS. 1 TO 8 INCLUSIVE

FIGS. 1 to 8 inclusive will be first described. The container or can to which this invention applies is of conventional character and is formed of metal or plastic and is generally indicated at 20. It has the conventional body 22 and is closed at the top with a top closure wall 24, the outer edge of which is bent upwardly and then over and downwardly and crimped to the upper edge of the body 22 to form the conventional rim generally indicated at 26. The cap locking member as shown in FIGS. 1 through 8 is adapted to be crimped or otherwise permanently secured to the rim 26.

Figure 1:
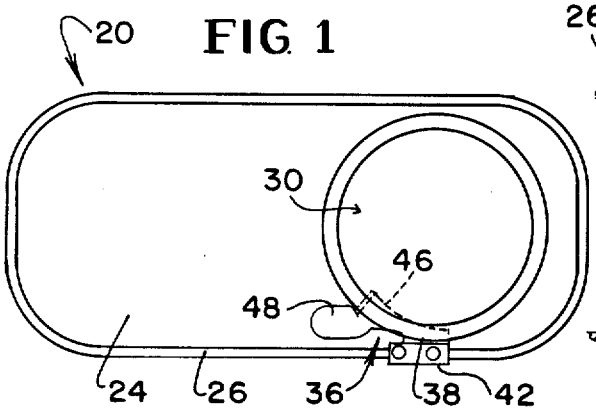
FIG. 1 is a top plan view of a container and cap with my invention applied thereto.
Figure 4:
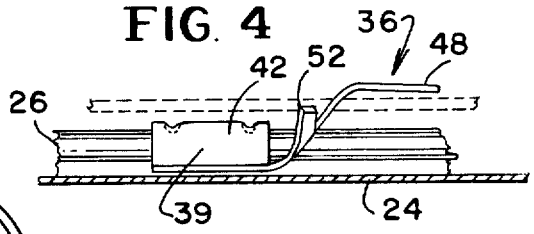
FIG. 4 is an enlarged elevational view looking at same from the inside and showing the cap in locked position by the cap locking member.
Figure 5:
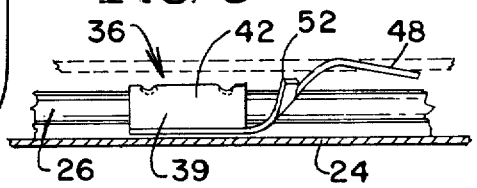
FIG. 5 is a view taken on line 5—5 of FIG. 3 but similar to FIG. 4, showing the cap locking member disengaged or unlocked from the cap.
Figure 2:
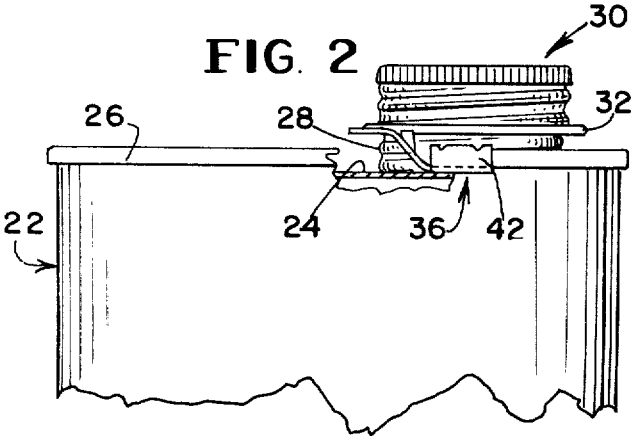
FIG. 2 is a side elevational view with a portion of the can or container cut away and showing this invention in locking position with respect to the cap.
Figure 6:
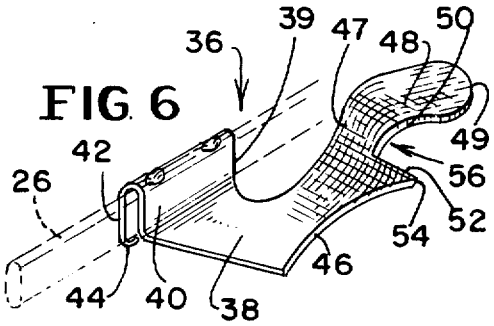
FIG. 6 is a perspective view of the cap locking member.
Figure 7:
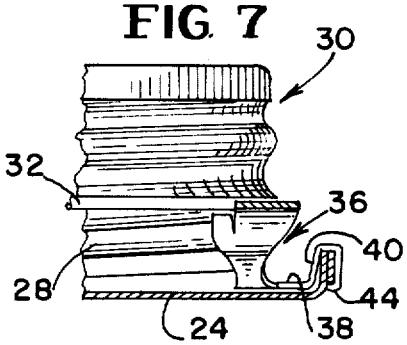
FIG. 7 is an elevational view and partly in section with the cap locking member disengaged from the cap.
Figure 3:
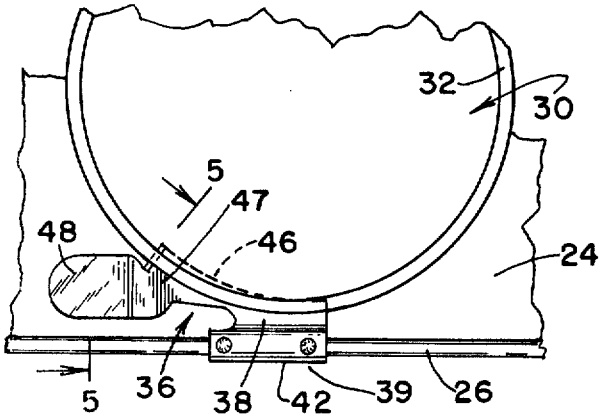
FIG. 3 is an enlarged top plan view of a portion of FIG. 1.
Figure 8:
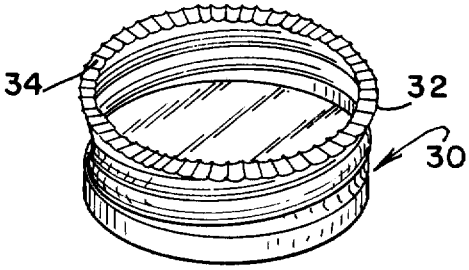
FIG. 8 is a perspective of the underside of the cap.

Extending upwardly of the top closure wall 24 is the conventional externally threaded neck or spout generally indicated at 28, which through the conventional opening is in communication with the interior of the body 22. An internally threaded cap generally indicated at 30, made preferably of metal, engages the neck or spout 28 for closing same. The bottom of the cap terminates in an annular outwardly extending lip or cap bead 32, the underside of which has serrations 34, as best shown in FIG. 8.

The member for locking the cap 30 in closed position, herein referred to as the cap locking member, is generally indicated at 36 and is formed of a spring steel or spring metal and is shaped to provide a body portion generally indicated at 38 which has an outer end 39 which is bent upwardly as at 40 and then extends over the rim 26 of the can or container and then bend downwardly as at 42 to terminate in an inwardly extending lip 44. The portion which extends over the rim is of an inverted U-shaped configuration and is crimped to the rim 26 to form a permanent attachment thereto. The body portion 38 is substantially flat and rests against the top wall 24 of the container and extends inwardly of the rim toward the neck or spout of the container.

The inwardly extending body portion 38 has an inner arcuate-shaped edge 46 which is concentric with the annular neck or spout 28 and said arcuate-shaped edge 46 abuts against the annular neck or spout. The body portion 38 has an upwardly extending portion 47 which then continues forwardly in a substantially horizontal portion 48, which horizontal portion is the manual engaging portion of the cap locking member. The horizontal portion 48 has a rounded outer edge 49 and an inner edge 50 which continues laterally to form a transversely extending front edge 52 having a pointed end 54. The transversely extending front edge 52 is inclined but is approximately at right angles to the longitudinal axis of the upwardly extending portion 47 and forms with the inner edge 50 a cap engaging notch or recess generally indicated at 56 which is adjacent the neck or spout of the container. A portion of the arcuate-shaped edge 46 extends upwardly as it is part of the upwardly extending portion 47.

As the cap 30 is screw-threaded into engagement with the neck or spout 28 of the container the lower lip or cap bead 32 of the cap rides in the notch or recess 56 of the cap locking member 36 and a portion of the transversely extending front edge 52 and pointed end 54 extend into the bottom of the cap and engage the underside of the lip or cap bead 32. As the cap is screwed down into sealing position, the upwardly extending portion 47 is slightly depressed and the front edge 52 imbeds itself into the underside of the cap and locks the cap in a closed position to prevent counterclockwise rotation of the cap. While the upwardly extending portion 47 is slightly depressed it will exert an upward pressure sufficient for the front edge 52 to forcibly engage the underside of the lip or cap bead 32 to firmly lock the cap to the cap locking member 36.

Before the cap can be unscrewed from the neck or spout, a person having sufficient manual strength must hold the container with one hand and with one of the fingers of that hand apply a downward pressure on the horizontal portion 48 of the cap locking member 36 so that the transversely extending front edge 52 and point 54 engaging the underside of the cap is disengaged from the underside of the cap, and with this downward manual pressure being held by finger of that one hand, the other hand is needed to rotate the cap in a counterclockwise rotation to unscrew the cap from the neck or spout end of the container. It thus requires the use of both hands and sufficient manual strength to accomplish this function, for the cap cannot be unscrewed with the cap locking member engaging the underside of the cap and locking the cap. After the cap has been unscrewed from the neck or spout and some of the contents used, the container or can may again be closed in the same manner as previously described, with the cap locked in a locking position. Therefore, until the entire contents of the container is used up the cap may be repeatedly locked and unlocked by the cap locking member.

To obtain a more positive locking, the underside of the lip or cap bead 32 can have a serrated surface 34, such as shown in FIG. 8, in which case the front edge 52 of the notch or recess 56 of the cap locking member 36 engages the serrated surface on the underside of the lip or cap bead 32 of the cap to make it still more difficult to rotate the cap in a counterclockwise rotation until such time as the horizontal portion 48 is depressed so that the front edge 52 on the notch disengages the serrations. As will be understood, when the cap is removed from engagement with the neck of the container the cap locking member assumes its original position.

FIGS. 9 TO 14 INCLUSIVE

Figure 10:
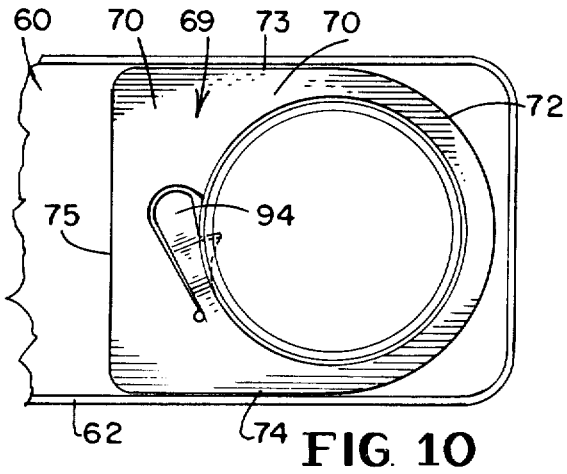
FIG. 10 is a top plan view showing the modified cap locking member in position around the neck of the container and in locking engagement with the underside of the cap.
Figure 13:
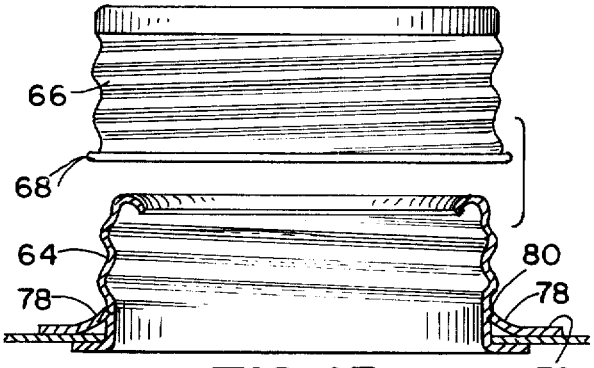
FIG. 13 is an exploded view partly in section showing the neck or spout of the container and the cap with the modified cap locking member surrounding the neck or spout and being secured thereto.
Figure 9:
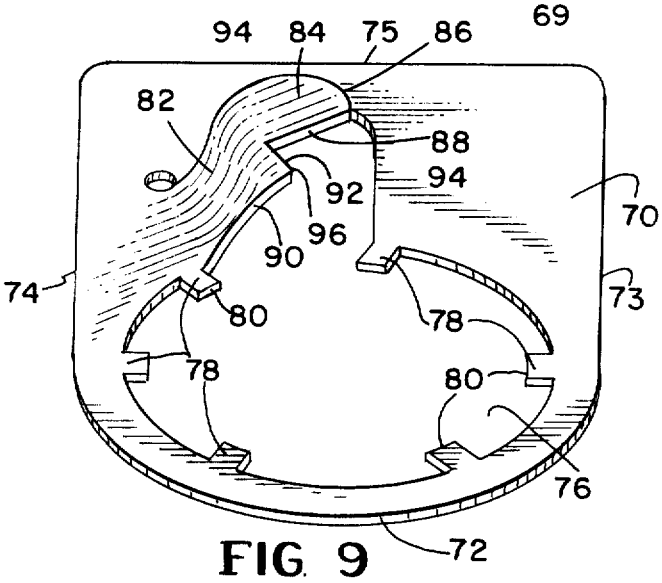
FIG. 9 is a perspective view of a modified cap locking member.
Figure 14:
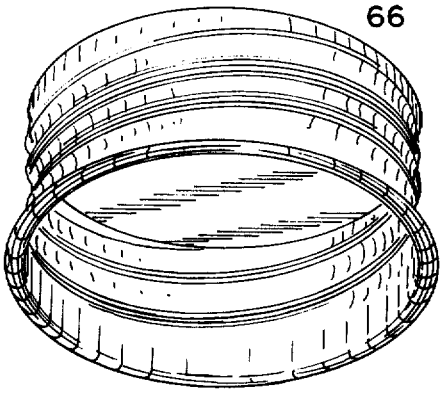
FIG. 14 is a perspective of a conventional cap taken from the underside thereof which may be used with the structure of FIGS. 1 through 7 or FIGS. 9 through 13.

The modified version is shown in FIGS. 9 to 14 inclusive. Instead of providing a cap locking member crimped to the rim of the container, as previously described, this cap locking member is positioned to extend around the spout or neck of the container and has means engaging the bottom of the neck of the container so that it remains attached to the can against removal therefrom. In this embodiment the container body has a top closure wall 60 which is crimped in the conventional manner to the body of the container and providing an upper rim 62 therefor. The container has the conventional externally threaded neck or spout 64 closed by the conventional metal cap 66. The cap has the conventional lip or cap bead 68, the underside of which may if desired have a serrated surface, similar to that shown in FIG. 8, although the serrated surface is not necessary. The cap locking member generally indicated at 69 and clearly shown in FIG. 9 has a flat body portion 70 having a curvilinear edge 72 at one end, spaced planar side edges 73 and 74 and a planar edge 75 opposite the curvilinear edge 72. The body portion 70 is provided with an annular opening 76 bounded by a plurality of spaced inwardly extending lugs 78 spaced around the inner opening, with edges 80 to engage the neck or spout 64 adjacent the bottom of the neck or spout. As best seen in FIG. 13, the lugs 78 are inclined upwardly at an angle to engage the bottom of the neck or spout and they thus anchor and secure the cap locking member 69 to the can or container against removal therefrom. Due to the shape of the flat portion 70, the curvilinear edge 72 and the planar side edges 73 and 74 will be positioned against the inside of the rim 62, as best shown in FIG. 10, and will be prevented from being rotated relative to the neck. The neck engaging surfaces or lugs 78 will prevent the cap locking member from being lifted upwardly of the neck or spout.

Figure 11:
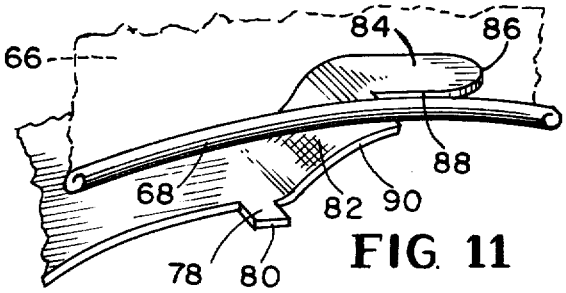
FIG. 11 is a fragmentary view of the modified cap locking member in locking position with respect to the cap bead.

Formed as an integral part of said cap locking member is an upwardly inclined extending portion 82 which continues with a forwardly extending substantially horizontal portion 84, which horizontal portion is the manual engaging portion of the cap locking member. The horizontal portion has a rounded edge 86 which continues inwardly to form an inner edge 88. The upwardly extending portion 82 also has an inner edge 90. Between the front end of the inner edge 90 and the inner edge 88 there is a transversely extending front edge 92 which with the inner edge 88 forms a notch or recess 94. The outer end of the transversely extending front edge 92 is somewhat pointed as at 96. When the cap is screwed onto the neck of the container the inner portion of the transversely extending front edge 92 of the notch or recess 94 will be positioned under the lip or cap bead 68 of the cap to ride therewithin, and as the cap is screwed into sealing position the upwardly extending portion 82 will be depressed and the transversely extending front edge 92 will tend to imbed itself into the underside of the lip or bead 68 of the cap, as best seen in FIG. 11, to lock it against counter-rotation.

Figure 12:
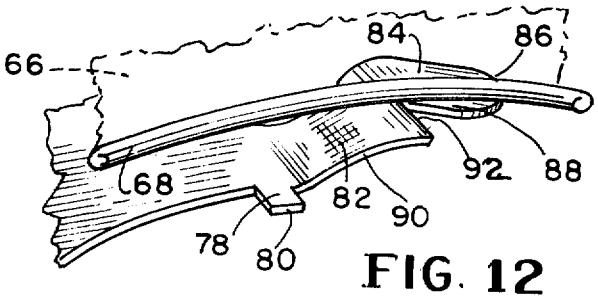
FIG. 12 is a view similar to FIG. 11 but showing the cap locking member in unlocked position with respect to the cap bead.

To unscrew the cap, one hand is used to hold the container and one of the fingers of that hand applies a downward manual pressure against the top horizontal portion 84 to depress it, as shown in FIG. 12, thereby disengaging the transversely extending front edge 92 from the underside of the cap, and simultaneously with the other hand the cap is unscrewed while the transversely extending front edge 92 is being held in its disengaged position. Thus, as previously described, only a person who has sufficient manual strength and using both hands can unscrew the cap from the container.

To further enhance the positive locking, the underside of the lip or bead portion 68 of the cap can be serrated, as shown in FIG. 8, and this will create a more effective interlocking between the cap locking means and the cap.

The embodiment shown in this version is likewise made of spring steel and is integrally formed or stamped as an integral unit.

What is claimed is:

1. A cap locking member for locking a cap or closure in a closed position relative to the neck or spout of the container, which neck or spout extends upwardly of the top wall of the container and with a rim extending around and upwardly of the top wall of the container and around the neck or spout, said cap locking member formed of a spring metal and having a portion engaging a portion of the rim and extending inwardly thereof in the direction of the neck or spout, said inwardly extending portion extending upwardly of the plane of the top wall of the container, said upwardly extending portion having a cap engaging edge, said cap engaging edge positioned contiguous to the bottom edge of the cap and engaging the underside of the bottom edge so that said cap engaging edge locks said cap against counterrotation, said cap locking member having a manually engageable portion adapted to be manually engaged by one hand and when sufficient downward pressure is applied thereagainst the cap engaging edge is depressed and disengaged from the underside of the cap to permit rotation of the cap in a counterdirection by the other hand, said spring metal returning said cap engaging edge to its predepressed position when the manual engaging portion is manually released.

2. A cap locking member as set forth in claim 1 in which the cap engaging edge extends transversely of the upwardly extending portion.

3. A cap locking member as set forth in claim 1 in which the cap locking member has an inwardly facing edge below said cap engaging edge and in which said inwardly facing edge is positioned adjacent the neck or spout.

4. A cap locking member as set forth in claim 2 in which the manually engageable portion extends forwardly of the transversely extending cap engaging edge.

5. A cap locking member as set forth in claim 4 which is secured to the rim of the container against removal therefrom and which has a notch or recess formed between the transversely extending cap engaging edge and the manually engageable portion.

6. A cap locking member as set forth in claim 5 which has means engaging the neck of the container to secure same against removal.

7. A cap locking member as set forth in claim 3 in which the inwardly facing edge is in the upwardly extending portion and is curvilinear to conform to the curvature of the neck or spout against which it is positioned.

8. A cap locking member as set forth in claim 1 which has a body portion which rests on the top wall of the container, which body portion is provided with an opening which surrounds the neck or spout and in which means are provided adjacent said opening which engage the neck or spout to prevent removal of said cap locking member.

9. A cap locking member as set forth in claim 8 in which the body portion of the cap locking member is shaped so that certain of the outer edges of the body portion engage the sides of the rim to prevent rotation of the cap locking member relative to the neck or spout.

* * * * *